US005316785A

United States Patent [19]

Yanai et al.

[11] Patent Number: 5,316,785

[45] Date of Patent: May 31, 1994

[54] METHOD AND APPARATUS OF FORMING A COATING FILM ON AN INNER SURFACE OF A PANEL OF A CATHODE RAY TUBE

[75] Inventors: Kunihiko Yanai; Yasuo Tanaka; Yasunori Niwa, all of Aichi, Japan

[73] Assignee: Sony Corporation, Tokyo, Japan

[21] Appl. No.: 766,509

[22] Filed: Sep. 27, 1991

[30] Foreign Application Priority Data

Sep. 28, 1990 [JP] Japan ..... 2-259570

[51] Int. Cl.[5] ..... B05D 5/06

[52] U.S. Cl. ..... 427/72; 427/68; 427/157; 427/240; 427/345

[58] Field of Search ..... 427/64, 68, 72, 240, 427/157, 345

[56] References Cited

U.S. PATENT DOCUMENTS

| | | | |
|---|---|---|---|
| 3,672,932 | 6/1972 | D'Augustine | 427/72 |
| 4,035,524 | 7/1977 | Fritsch | 427/68 |
| 4,078,095 | 3/1978 | Ratay | 427/68 |
| 4,254,160 | 3/1981 | Raih | 427/57 |
| 4,908,232 | 3/1990 | Itou et al. | 427/72 |

FOREIGN PATENT DOCUMENTS

| | | |
|---|---|---|
| 55-21835 | 2/1980 | Japan . |
| 57-113537 | 7/1982 | Japan . |
| 60-101831 | 6/1985 | Japan . |
| 61-168837 | 7/1986 | Japan . |
| 2225157 | 5/1990 | United Kingdom . |

*Primary Examiner*—Janyce Bell
*Attorney, Agent, or Firm*—Hill, Steadman & Simpson

[57] ABSTRACT

The present invention is directed to a method of and apparatus for forming a coating film on an inner surface of a panel of a cathode ray tube. In this case, slurries are injected into the panel, the panel is rotated on its own axis so as to uniformly coat the slurries on the panel and a recovering hood is moved in an opposing relation to the panel in synchronism with the revolution of the panel to thereby recover the slurries. Therefore, particularly when the slurries are recovered, the slurries can be prevented from being scattered, thereby avoiding the surroundings from being splattered.

9 Claims, 9 Drawing Sheets

METHOD AND APPARATUS OF FORMING A COATING FILM ON AN INNER SURFACE OF A PANEL OF A CATHODE RAY TUBE

BACKGROUND OF THE INVENTION

1. Field of the Invention

The present invention generally relates to methods of manufacturing a cathode ray tube and, more particularly, is directed to a method of and apparatus for injecting and recovering slurries in the process for making a phosphor screen.

2. Description of the Prior Art

When a phosphor screen of a color cathode ray tube is produced, so-called slurries, such as phosphor slurries of respective colors, carbon slurries, PVP photosensitive liquid, PVA photosensitive liquid or the like are injected into a panel in response to the respective processes, are uniformly coated on the whole surface of the panel, and then extra slurries within the panel are recovered.

In the prior art, as shown in FIG. 1, a panel 1 is located so as to face the inner surface thereof upwardly and a desired slurry 3 is injected through an injection nozzle 2 into the inner surface of the panel 1 (see FIG. 1A). Then, the panel 1 is rotated on its own axis (in the direction shown by an arrow a in FIG. 1B) so as to spread and coat the slurry 3 on the entire surface of the panel (see FIG. 1B). Thereafter, the panel 1 is revolved (in the direction shown by an arrow b in FIG. 1C) such that the corner portion of the panel 1 is faced downwardly to thereby exhaust extra slurry 3 from the panel 1 (see FIG. 1C). The panel 1 is then rotated on its own axis (in the direction shown by an arrow a) so as to urge the slurry of a desired film thickness to be coated thereon (see FIG. 1D). Thus, the coating process of slurry is finished.

According to the above conventional method in which the desired slurry 3 is injected into the panel 1, the panel 1 is revolved (in the direction shown by the arrow b) and then the panel is rotated on its own axis (in the direction shown by the arrow a in FIG. 1D) to provide the slurry of desired film thickness thereby removing the extra slurry 3 from within the panel, the slurry 3 is considerably scattered to the surroundings and the surroundings are contaminated.

OBJECTS AND SUMMARY OF THE INVENTION

Accordingly, it is an object of the present invention to provide an improved manufacturing method and apparatus of a cathode ray tube having a process to recover a phosphor slurry from a panel in which the aforementioned shortcomings and disadvantages encountered with the prior art can be eliminated.

More specifically, it is an object of the present invention to provide a manufacturing method and apparatus of a cathode ray tube having a process to recover a phosphor slurry in which the phosphor slurry can be prevented from being scattered.

Another object of the present invention is to provide a manufacturing method and apparatus of a cathode ray tube having a process to recover a phosphor slurry in which the slurry can be recovered from a panel while the slurry can be prevented from being scattered to the surroundings.

A further object of the present invention is to provide a manufacturing method and apparatus of a cathode ray tube having a process to recover a phosphor slurry in which the slurry can be saved.

As an aspect of the present invention, a method of forming a coating film on an inner surface of a panel of a cathode ray tube is comprised of the steps of holding the panel of a cathode ray tube such that the inner surface of the panel is directed upward at a predetermined angle, disposing an injection nozzle at a predetermined position by a robot so as to inject a slurry containing composition to be coated into the inner surface of the panel by means of the injection nozzle, rotating the panel on its own axis to uniformly coat the slurry on the inner surface of the panel, and revolving the panel and moving a recovering hood in an opposing relation to the inner surface of the panel in synchronism with the revolution of the panel thereby to recover extra slurry within the panel into the recovering hood.

As a second aspect of the present invention, a method of forming a coating film on an inner surface of a panel of a cathode ray tube is comprised of the steps of holding the panel of a cathode ray tube such that the inner surface of the panel is directed upward at a predetermined angle, disposing an injection nozzle at a predetermined position by a robot so as to inject a slurry containing composition to be coated into the inner surface of the panel by means of the injection nozzle, rotating the panel on its own axis to uniformly coat the slurry on the inner surface of the panel, revolving the panel and moving a recovering hood in an opposing relation to the inner surface of the panel in synchronism with the revolution of the panel thereby to recover extra slurry within the panel into the recovering hood, holding the panel at the final revolution position such that the inner surface of the panel is directed downward at a predetermined angle, rotating the panel on its own axis at high speed such that the slurry coated on the inner surface of the panel has a proper film thickness, and placing the recovering hood used to a predetermined keeping position at which the recovering hood used is cleaned by a cleaning jig of the robot.

In accordance with a third aspect of the present invention, an apparatus is provided for forming a coating film on an inner surface of a panel of a cathode ray tube comprising a panel clamping apparatus for holding a panel of a cathode ray tube, a vertical revolute robot, an injection nozzle for injecting a slurry into the inner surface of the panel, a recovering hood for recovering therein an extra slurry, and a cleaning device for cleaning the inside of the recovering hood, wherein the panel clamping apparatus can automatically rotate the panel on its own axis and revolve the panel independently, and the vertical revolute robot is of an exchangeable type which utilizes commonly at least the slurry injection nozzle, the slurry recovering hood and the hood cleaning means in response to a position signal supplied thereto from the panel clamping apparatus.

The above and other objects, features, and advantages of the present invention will become apparent from the following detailed description of an illustrative embodiment thereof to be read in conjunction with the accompanying drawings, in which like reference numerals are used to identify the same or similar parts in the several views.

DETAILED DESCRIPTION OF THE PREFERRED EMBODIMENT

Figure 1A:
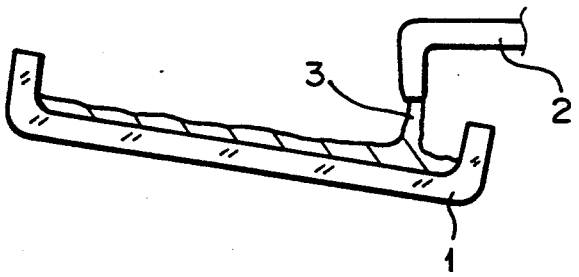
FIG. 1A (PRIOR ART)
FIGS. 1A, 1B, 1C and 1D are respectively process diagrams showing an example of how to inject and recover the slurry according to the prior art.
Figure 1B:
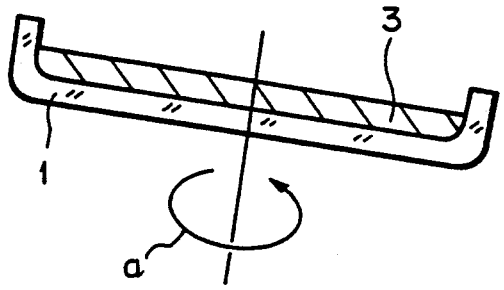
FIG. 1B (PRIOR ART)
Figure 1C:
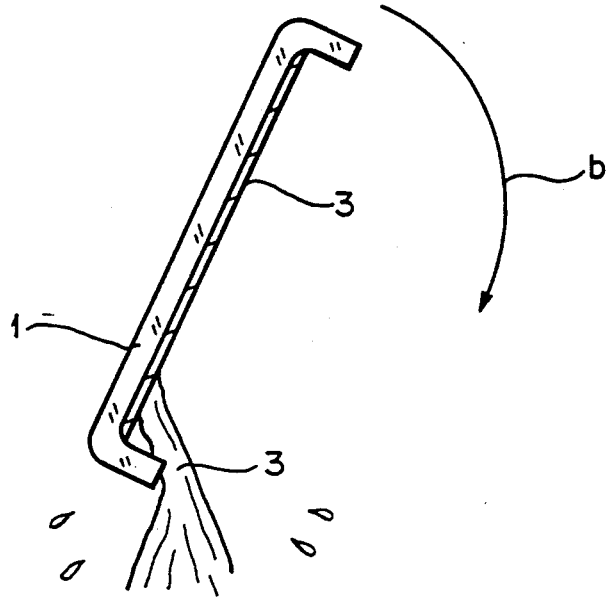
FIG. 1C (PRIOR ART)
Figure 1D:
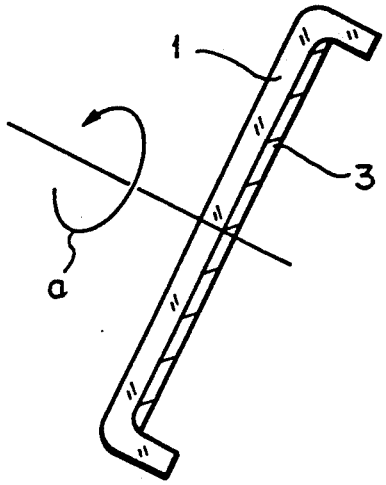
FIG. 1D (PRIOR ART)

In order to facilitate the understanding of this embodiment, an example of the process of making a color phosphor screen of a color cathode ray tube will be described. A PVP (polyvinyl pyrrolydone) photosensitive liquid is injected into the inner surface of a panel of a cathode ray tube to form a PVP photosensitive layer having a uniform film thickness. After being dried, the thus formed photosensitive layer is exposed by using a color selecting electrode as an optical mask and developed by a rinsing-process by water or the like to thereby form resist layers of strip patterns on the photosensitive layer at positions corresponding to respective colors. Then, a carbon slurry is injected into the whole inner surface of the panel including the resist layers to form a uniform carbon layer. After a dry-process, a reversing agent, e.g., hydrogen peroxide, is injected into the inner surface of the panel to dissolve the resist layers, and the resultant product is reverse-developed by the rinsing-process by water (i.e., the resist layer and the carbon layer formed on the resist layer are both lifted off) to thereby form carbon stripes of a predetermined pattern, i.e., black stripes. Then, a PVA (polyvinyl alcohol) photosensitive liquid is injected into the panel to form a PVA photosensitive layer of a uniform film thickness. After the dry-process, the resultant layer is exposed in accordance with two colors of, for example, red and blue by using the color selecting electrode as the optical mask, and developed by the rinsing-process by water, thereby resist layers being formed on the resultant layer at its portions corresponding to two colors of red and blue. Then, a green phosphor slurry is injected into and coated on the panel, dried and then exposed in its outer surface from the front surface of the panel. In the next process, the reversing agent, e.g., hydrogen peroxide, is injected into the resultant product to dissolve the resist layer, and reverse-developed (i.e., the resist layer and the phosphor slurry on the resist layer are both lifted off) by the rinsing-process by water, thereby a green phosphor stripe being formed on the resultant product at its position between predetermined carbon stripes. In a like manner (external exposure, reverse-development and so on are performed), red and blue phosphor stripes are formed on the resultant product at its positions between other predetermined carbon stripes. In the next process, hot water is injected into the panel to raise a temperature of the panel, an intermediate layer is formed and an all metal backing layer is further formed, thereby a target color phosphor screen being formed.

In the following embodiment, the present invention is applied to the process for injecting phosphor slurries of respective colors into the panel and the process for recovering the slurries from the panel in the above process for producing a phosphor screen.

An embodiment of the present invention will hereinafter be described in association with the apparatus therefor.

Figure 2:
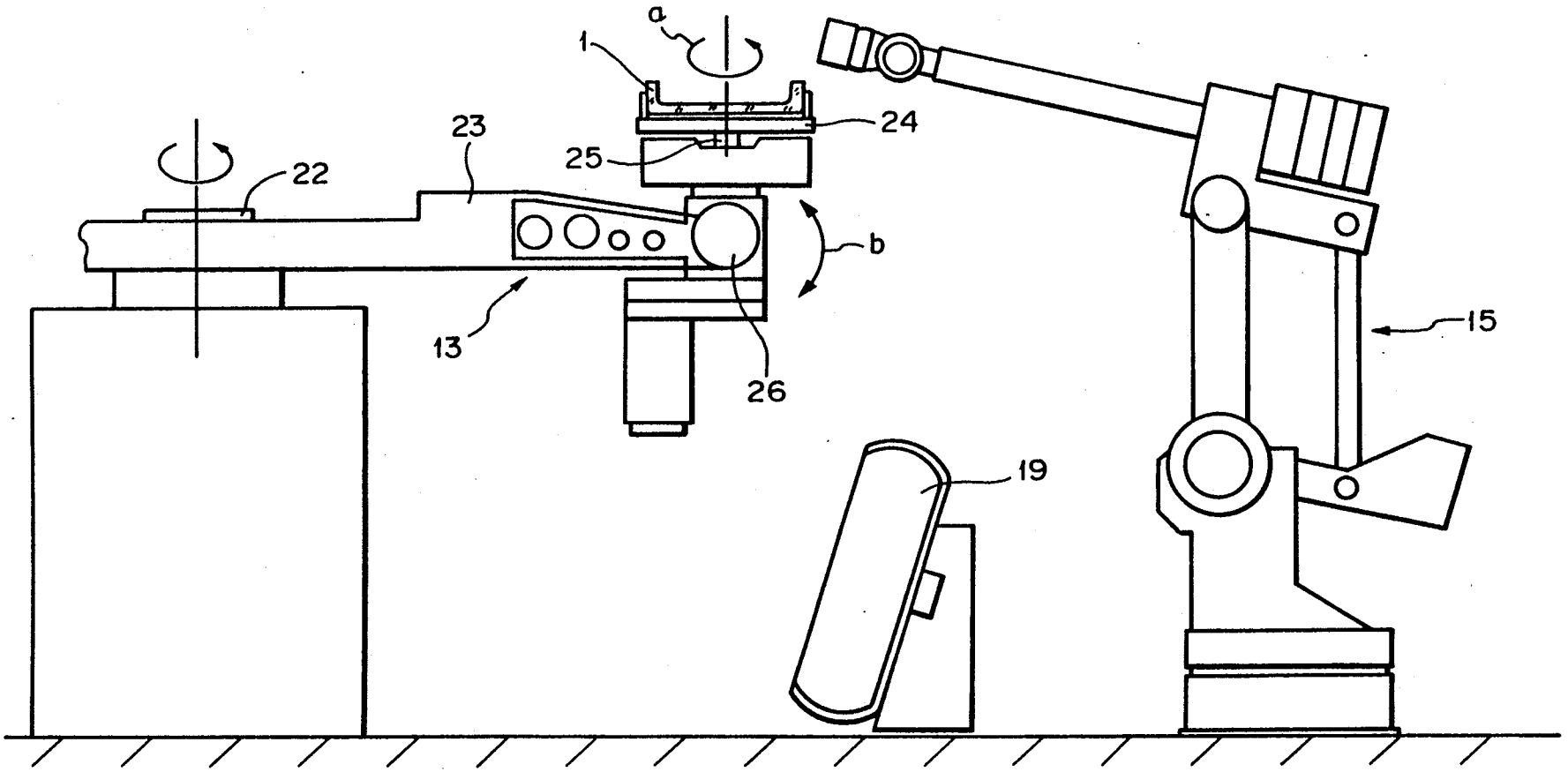
FIG. 2 is a diagram showing an arrangement of a treatment apparatus to which the present invention is applied.
Figure 3:
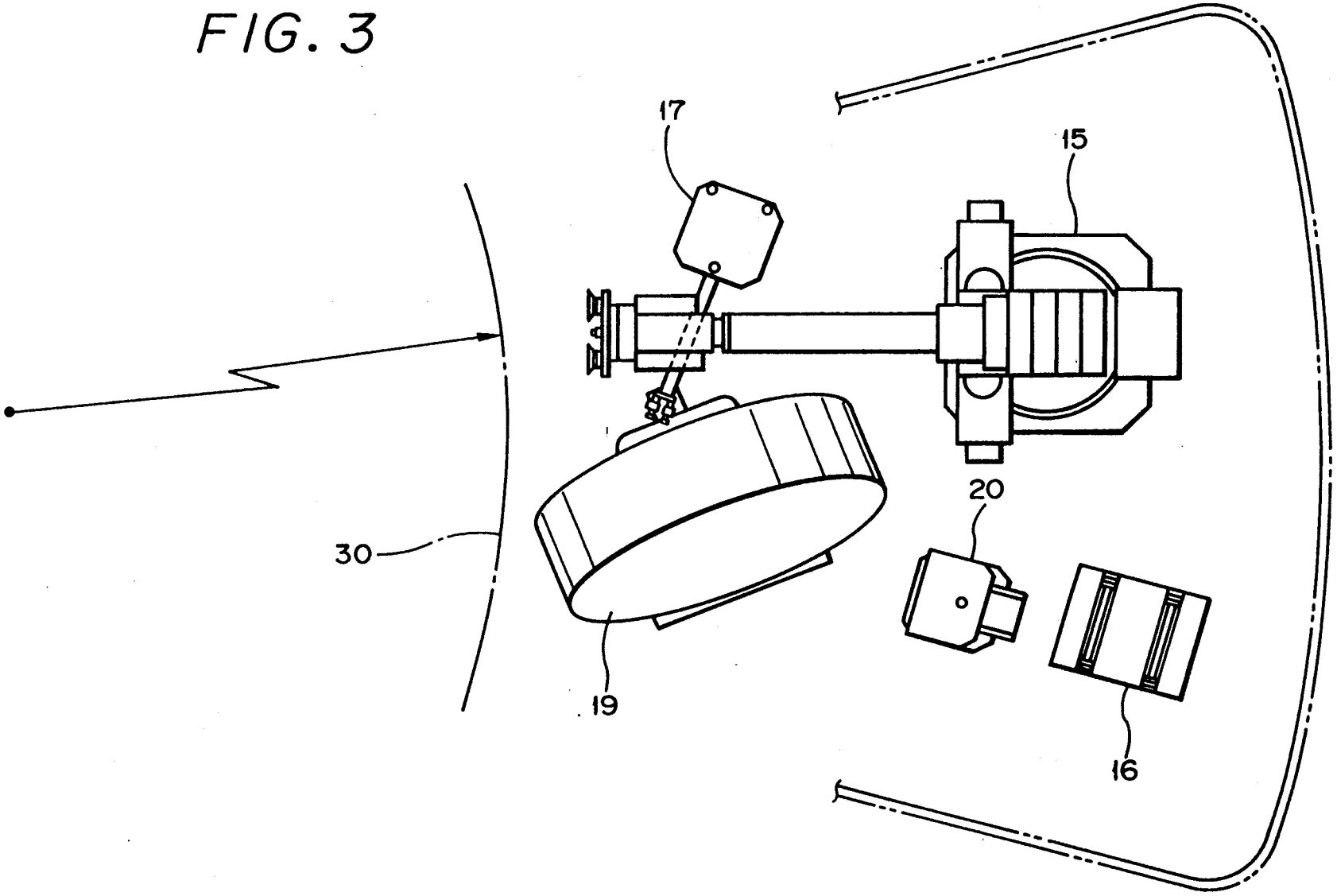
FIG. 3 is a plan view of the main portion thereof.

FIG. 2 shows an apparatus 11 for injecting slurries and also recovering the slurries according to the present invention. FIG. 3 is a plan view illustrating a layout of a robot, an injection nozzle, a recovery hood cleaning sponge brush or the like of the above apparatus.

Referring to FIGS. 2 and 3, a treatment apparatus 11 is composed of a panel clamping device 13 for clamping the panel 1, a vertical revolute 6-axis robot 15, a slurry injection nozzle 17, a slurry recovery hood 19, a cleaning means for cleaning the inside of the recovery hood, such as a sponge brush 20 and a cleaning tank 16 in which the sponge brush 20 is washed and so on.

The panel clamping device 13 includes a clamping head 24 which substantially holds the panel 1 on the top of an arm 23 rotating intermittently, for example, about a main shaft 22 within the horizontal plane. The clamping head 24 can make the panel 1 rotatable in the rotation direction (shown by an arrow a in FIG. 2) and in the revolution direction (shown by an arrow b in FIG. 2) by means of a rotation shaft 25 and a revolution shaft 26 and also clamps the panel 1 with its outside four sides.

The robot 15 is what might be called an exchangeable-type robot and is controlled by a computer so as to selectively exchange the injection nozzle 17, the recovery hood 19 and the cleaning sponge brush 20 so that the robot may be operated in accordance with the works of the respective processes.

The injection nozzle 17, the recovery hood 19 and the cleaning sponge brush 20 are respectively placed at predetermined positions on a temporary table as shown in FIG. 3. In FIG. 3, a chain line 30 shows an area in which the panel clamping device 13 is operable.

Figure 5:
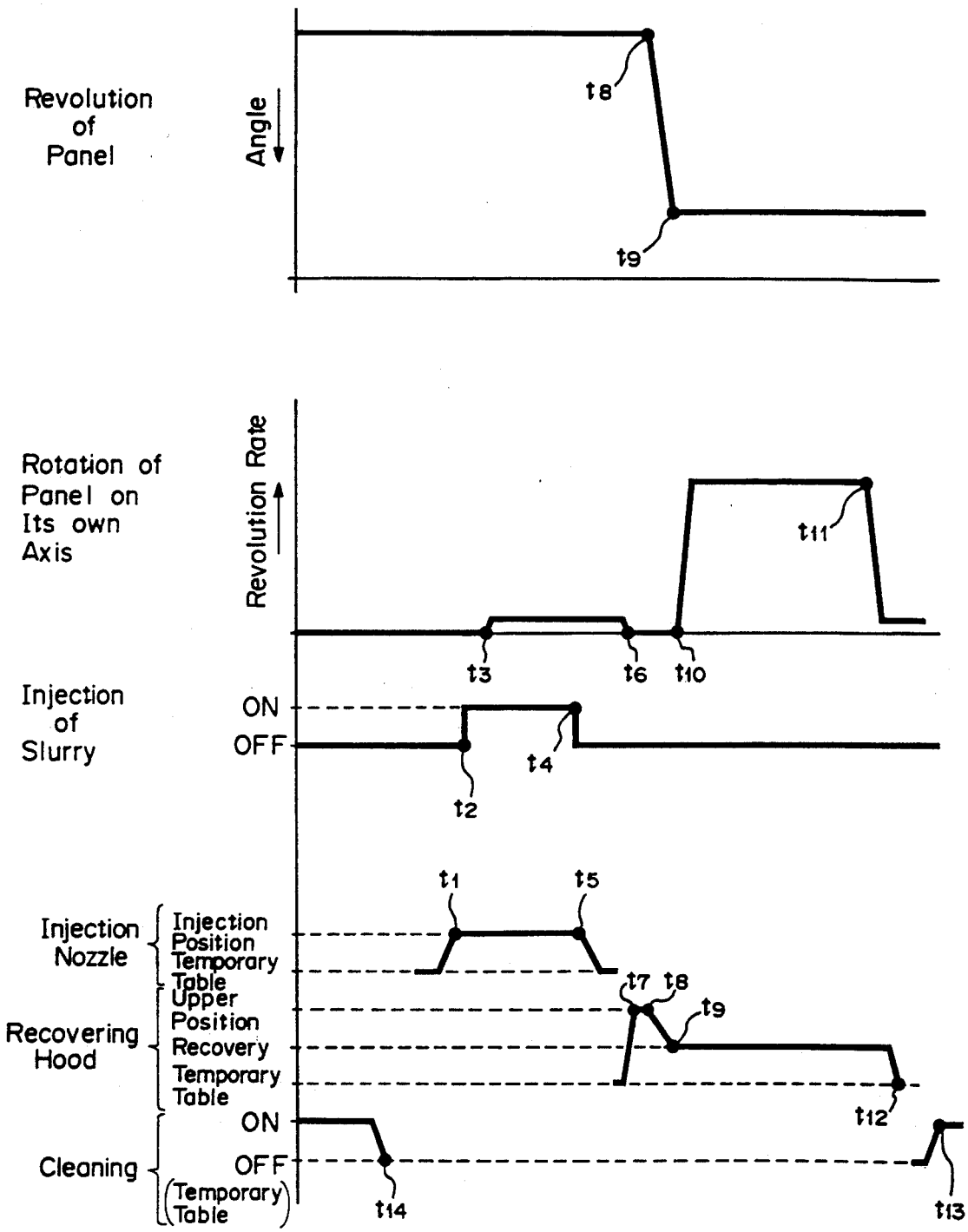
FIG. 5 is a timing chart of the processes in which the slurry is injected and recovered by using the treatment apparatus.

According to the method of this embodiment, the slurry will be injected and recovered by the above apparatus 11 as follows. FIG. 5 shows a timing chart of motions of respective parts.

Figure 4A:
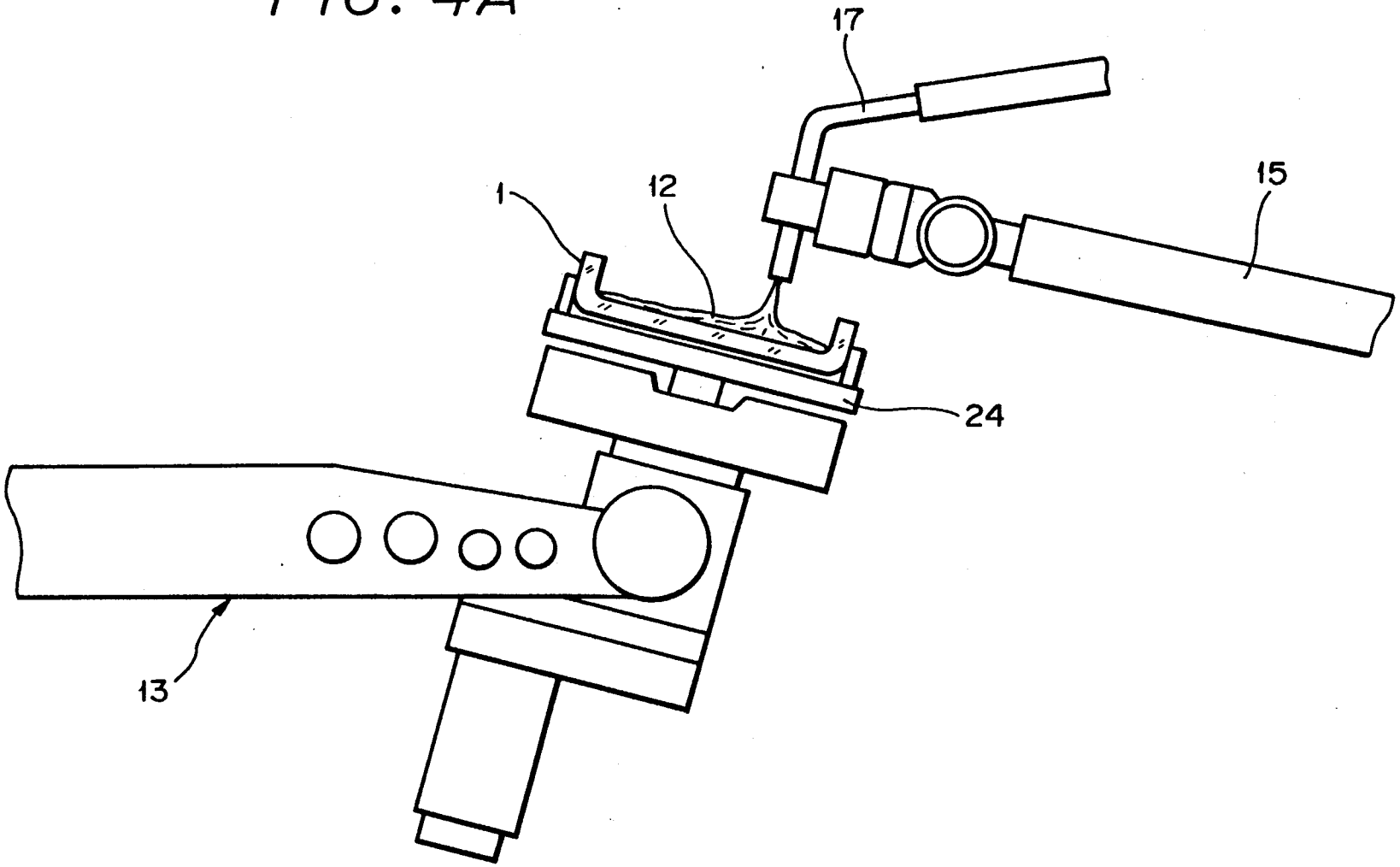
FIGS. 4A 4B, 4C, 4D and 4E are respectively diagrams used to explain processes of a method of injecting and recovering slurry according to the present invention.

As shown in FIG. 4A, the panel 1 is held by the clamping head 24 of the panel clamping device 13 so that the inner surface of the panel 1 is directed upward at a predetermined angle. Then, the injection nozzle 17 is clamped by the robot 15 and moved to the injection position at timing point $t_1$ of FIG. 5. Thereafter, the injection of the phosphor slurry 12 into the panel 1 is started (at timing point $t_2$ of FIG. 5). During the period when phosphor slurry 12 is being injected into the panel 1, the phosphor slurry 12 may be injected into the panel 1 while the injection nozzle 17 is being regularly translated (moved) in a scanning fashion. From timing point $t_3$ after the injection of the phosphor slurry 12 into the panel 1 is started, the panel 1 is started to rotate on its own axis (at low speed). At timing point $t_4$, the injection of the slurry 12 into the panel 1 is finished and after the injection of the slurry 12 is ended, the injection nozzle 17 is returned to the predetermined position (on the temporary table) at which the clamping of the injection nozzle 17 by the robot 15 is loosened.

Figure 4B:
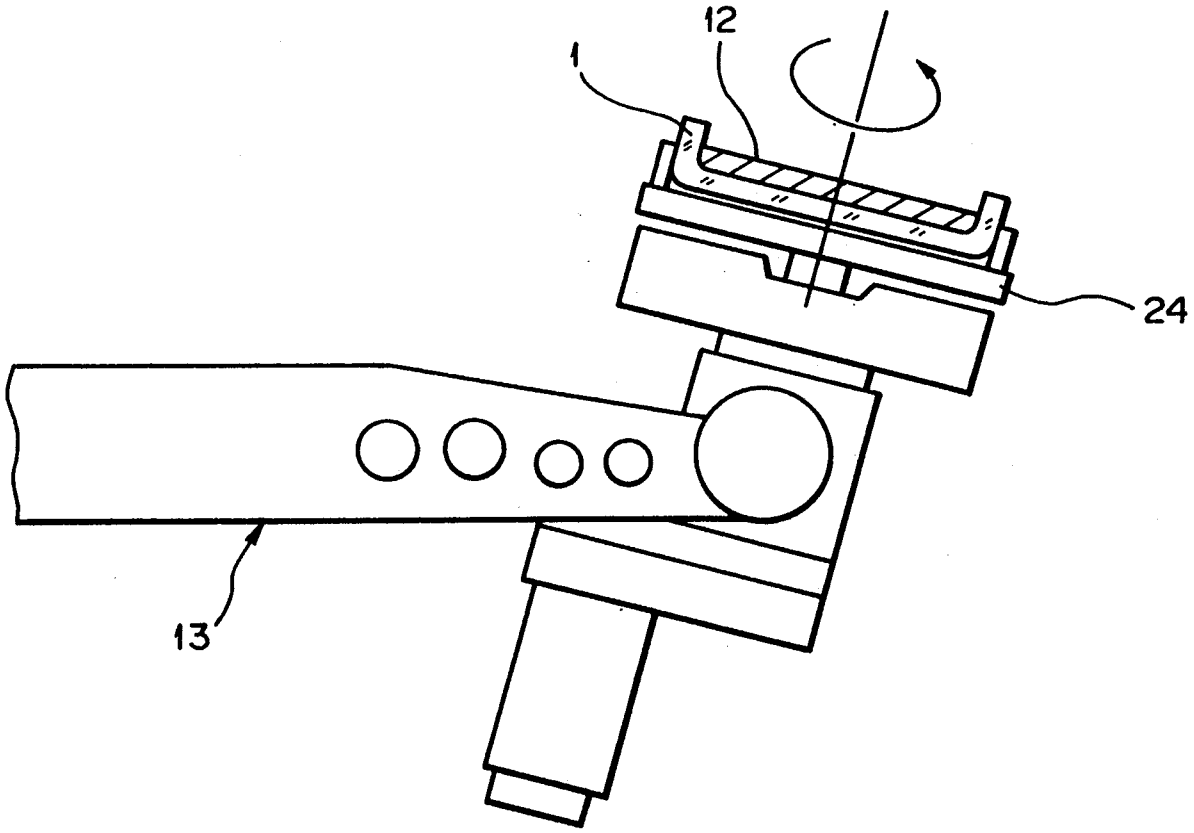

The panel 1 is continued to rotate about the rotation shaft 25 at low speed so as to uniformly coat the phosphor slurry 12 on the entire surface of the panel 1 as shown in FIG. 4B, and then the panel 1 stops being rotated on its own axis at timing point $t_6$.

Figure 4C:
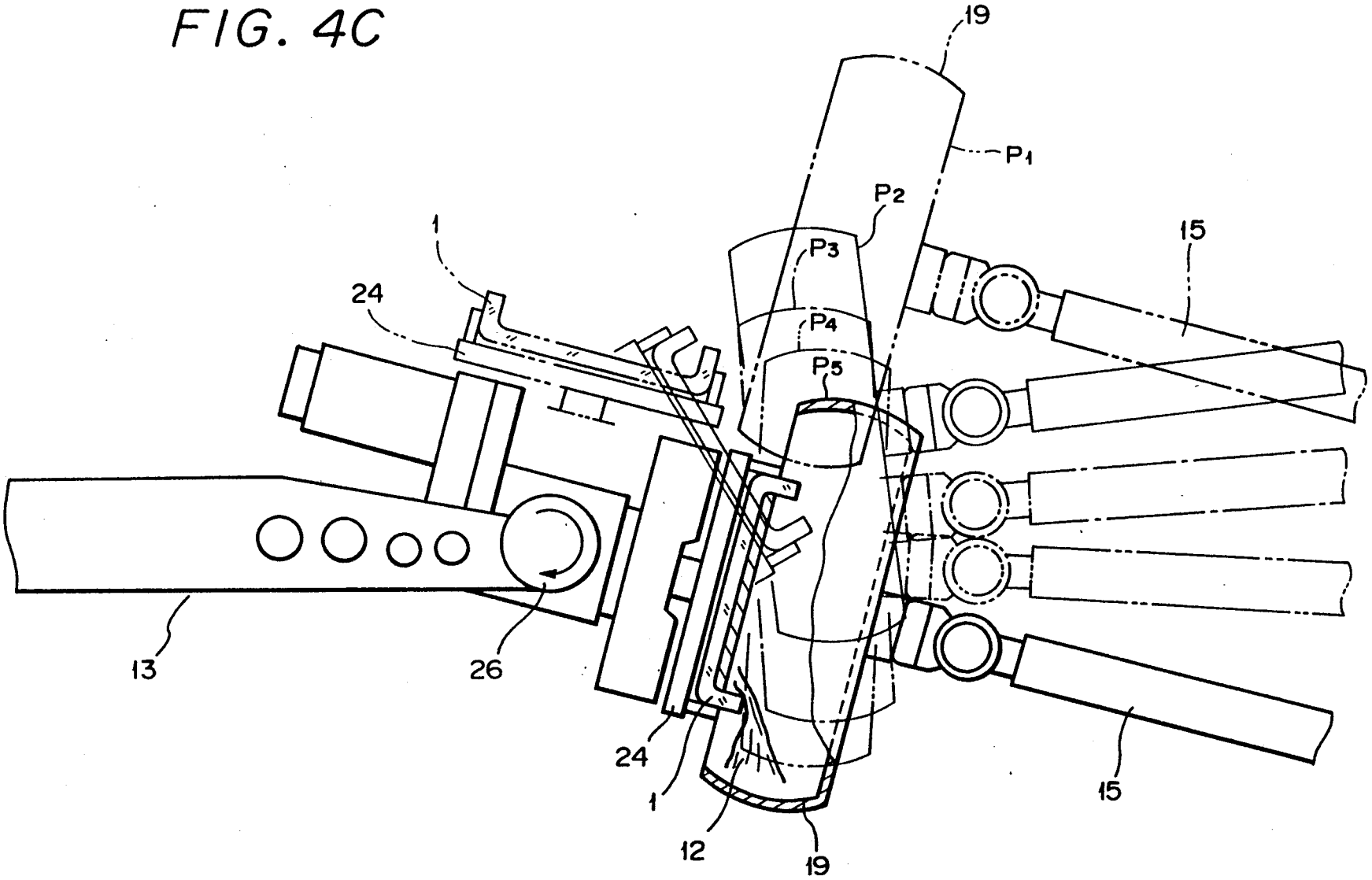

Then, as shown in FIG. 4C, the recovery hood 19 is clamped by the robot 15 and moved to a desired position $P_1$, near the panel 1 (at timing point $t_7$ of FIG. 5). Thereafter, the panel 1 is revolved about the revolution shaft 26 and the recovery hood 19 is moved in synchronism with the revolution of the panel 1 in an opposing relation to the inner surface of the panel 1, that is, the recovery hood 19 is moved along a locus shown by the positions $P_1$ to $P_5$ in synchronism with the revolution of the panel 1, thereby the extra phosphor slurry 12 within the panel 1 being fully recovered back into the recovery hood 19 (the recovery of slurry is started at timing point $t_8$ and the recovery of slurry is finished at timing point $t_9$). When the position of the recovery hood 19 is controlled, a rotational position information from a revolution AC servo mechanism (not shown) of the clamping head 24 is supplied to the robot 15 side, whereby the position of the recovery hood 19 is reproduced by the robot 15. At that time, the recovery hood 19 is moved so as to receive the panel 1 therein and substantially parallelly opposed to the panel 1 at the final revolution position $P_5$ under the condition such that the panel 1 is inserted into the recovery hood 19 by a predetermined amount d (e.g., approximately d=100 mm).

Figure 4D:
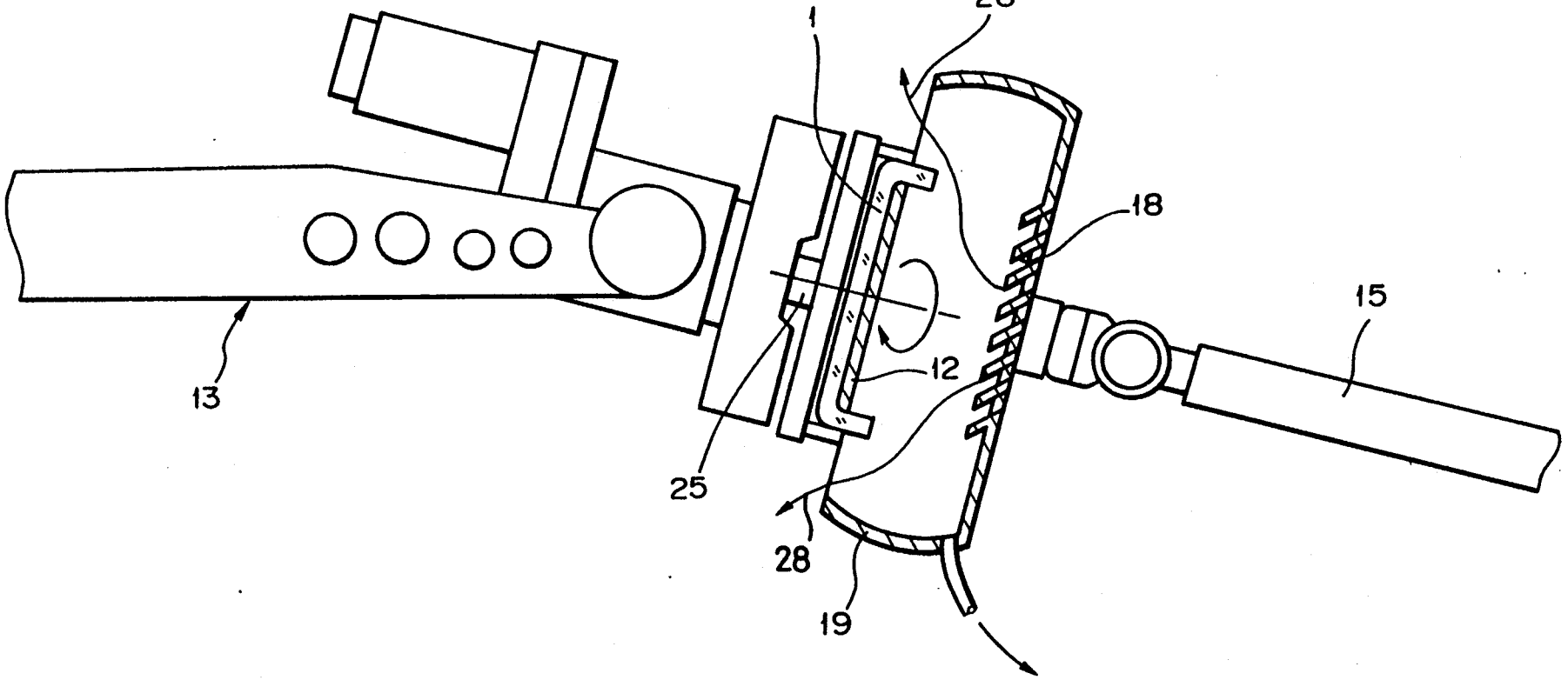

Then, as shown in FIG. 4D, at the final revolution position $P_5$ of the panel 1, the panel 1 is rotated about the rotation shaft 25 (at high speed) so that the phosphor slurry 12 of proper film thickness is coated on the panel 1 (the panel 1 starts rotating on its own axis at timing point $t_{10}$ and stops rotating on its own axis at timing point $t_{11}$). When the phosphor slurry is uniformly coated on the panel 1, a turbulence tends to take place within the recovery hood 19 so that slurries are spattered within the recovery hood 19, thus resultant slurry spray can be scattered to the panel 1 side. In order to prevent the occurrence of turbulence, the recovery hood 19 has through its rear surface formed an air escape hole 18 of a shutter configuration, whereby air is escaped from the inside of the recovery hood 19 through this air escape hole 18. Also, air flow 28 is produced by the absorption of air from the rear side of the recovery hood 19 to prevent the occurrence of turbulence, thereby preventing the spray of slurry from being scattered to the panel 1 side.

The slurry 12 recovered into the recovery hood 19 is returned to a recovery tank, not shown, and supplied to an ordinary slurry tank, and also supplied from this slurry tank to the injection nozzle 17, thereby being recycled.

Figure 4E:
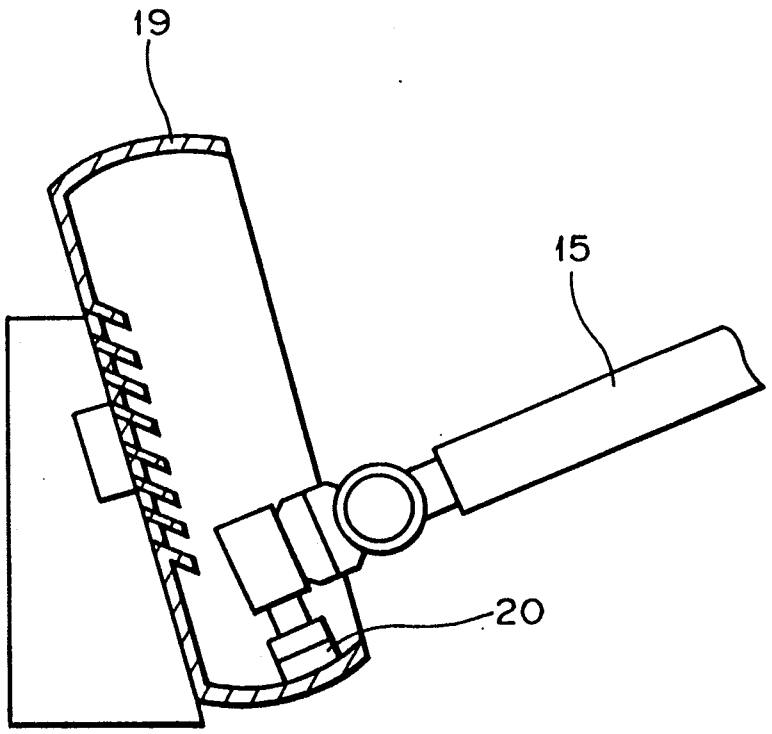

After the film thickness of the slurry becomes proper, as shown in FIG. 4E, the recovery hood 19 is placed at the predetermined position (on the temporary table) (at timing point $t_{12}$ of FIG. 5) and the cleaning means for cleaning the inside of the recovery hood 19, i.e., the sponge brush 20 is clamped by the robot 15 (at timing point $t_{13}$ of FIG. 5) so as to urge the sponge brush 20 to contact with the inner circumferential side surface of the recovery hood 19. Also, the sponge brush 20 is moved along the inner circumferential side surface of the recovery hood 19 by the robot 15 to thereby clean the whole surface of the inner circumferential side of the recovery hood 19. After the inner circumferential whole surface of the recovery hood 19 is cleaned, the sponge brush 20 is cleaned in the cleaning tank 16 and then the sponge brush 20 is returned to the predetermined position (on the temporary table) (at timing point $t_{14}$ of FIG. 5). The inner circumferential side surface of the recovery hood 19 may be cleaned each time the slurry 12 is recovered (every time) or at the intervals in which the slurry 12 is recovered a plurality of times.

According to the above embodiment, when the panel 1 is revolved to recover the phosphor slurry 12 after the phosphor slurry 12 is injected into and uniformly spread into the panel 1, the recovery hood 19 is moved in an opposing relation to the panel 1 in synchronism with the revolution of the panel 1 (i.e., in such a manner as to insert the panel 1 into the recovery hood 19), whereby the phosphor slurry 12 can be recovered without being scattered to the surroundings, thus to reduce the contamination on the surroundings.

Furthermore, since the inner surface of the recovery hood 19 is cleaned by the sponge brush 20 each time the phosphor slurry 12 is recovered, the inner circumferential side surface of the recovery hood 19 can be prevented from being smudged by the slurry. Thus, when the film thickness of the slurry is made uniform, defects due to the splash of slurry can be alleviated.

Furthermore, since the recovery hood 19 can be positioned with large freedom by the robot 15 in accordance with the size of the panel 1, the phosphor slurry can be prevented from being scattered regardless of the kind of cathode ray tubes being coated when the phosphor slurry is recovered. In addition, when the phosphor slurry 12 is recovered and recycled, phosphor slurries otherwise scattered can be effectively utilized and saved, unlike the prior art.

When the phosphor slurry 12 is injected into the panel 1, the injection position of the slurry 12 by the injection nozzle 17 can be freely selected by the robot 15 in accordance with the kind of cathode ray tube being coated. In addition, since the injection nozzle 17 is regularly translated in a scanning fashion in injecting the slurry into the panel 1, the panel 1 having a small aspect ratio can be coated with a small amount of slurry, thus not only preventing the slurry from being scattered but also saving the slurry.

While the present invention is applied to the injection and recovery processes of phosphor slurry as described above, the present invention is not limited thereto and may be applied to the injection and recovery processes of carbon slurry, slurries of PVP photosensitive liquid, PVA photosensitive liquid or the like.

According to the present invention, when the extra slurry of the slurry injected into the panel in the process of making the phosphor screen is recovered, the slurry can be prevented from being scattered to the outside. Therefore, the surroundings can be prevented from being smudged or contaminated by the slurry, and reliability in the manufacturing process can be improved.

Having described the preferred embodiment of the invention with reference to the accompanying drawings, it is to be understood that the invention is not limited to that precise embodiment and that various changes and modifications thereof could be effected by one skilled in the art without departing from the spirit or scope of the novel concepts of the invention as defined in the appended claims.

We claim as our invention:

1. A method of forming a coating film on an inner surface of a panel of a cathode ray tube comprising the steps of:

(a) holding said panel of said cathode ray tube such that the inner surface of said panel is directed upwardly;

(b) disposing an injection nozzle by a robot so as to inject a slurry containing composition to be coated into the inner surface of said panel by means of said injection nozzle;

(c) rotating said panel on its own axis to uniformly coat said slurry on the inner surface of said panel; and (d) revolving said panel downwardly to a position where the inner surface is inclined downwardly, and moving a recovering hood in an opposing relation to the inner surface of said panel in synchronism with the revolving of said panel, said hood being concave and open to said panel, said hood moving downwardly with said panel during revolving of said panel and oriented toward said panel thereby to recover extra slurry within said panel into said recovering hood during the downward revolving of said panel.

2. The method according to claim 1, in which said robot is an exchangeable type robot and said injection step, recovering step and said cleaning step are performed by means of exchanging jigs of said exchangeable type robot under the control of a program of a computer.

3. The method according to claim 1 comprising the further step of:

(e) once said panel is revolved downwardly to said position, rotating said panel on its own axis.

4. The method according to claim 3, wherein at said position said panel is partially inserted into said recovery hood.

5. The method according to claim 3, wherein the rotation of said panel during step (e) is characterized in that the rotation is at a greater speed than when rotating said panel during step (c).

6. The method according to claim 5, wherein said step (c) rotating said panel is discontinued before step (d) revolving said panel.

7. The method according to claim 1, wherein said step (c) rotating said panel is discontinued before step (d) revolving said panel.

8. A method forming a coating film on an inner surface of a panel of a cathode ray tube comprising the steps of:

(1) holding said panel of said cathode ray tube such that the inner surface of said panel is directed upwardly;

(2) disposing an injection nozzle by a robot and injecting a slurry containing composition to be coated into the inner surface of said panel by means of said injection nozzle;

(3) rotating said panel about its own axis to uniformly coat said slurry on the inner surface of said panel;

(4) revolving said panel downwardly and moving a recovering hood in an opposing relation to the inner surface of said panel in synchronism with the revolution of said panel, said hood being concave and open to said panel, said hood moving downwardly with said panel during revolving of said panel and oriented toward said panel thereby to recover extra slurry within said panel into said recovering hood during the downward revolving of said panel;

(5) holding said panel at the final revolving position such that the inner surface of said panel is directed downwardly;

(6) rotating said panel on its own axis at high speed such that said slurry coated on the inner surface of said panel has a uniform film thickness; and (7) placing said recovering hood to a keeping position and cleaning said recovering hood by a cleaning jig of said robot.

9. The method according to claim 8, in which said robot is an exchangeable type robot and said injection step, recovering step and said cleaning step are performed by means of exchanging jigs of said exchangeable type robot under the control of a program of a computer.

* * * * *